United States Patent [19]

Antlfinger et al.

[11] 4,405,325

[45] Sep. 20, 1983

[54] HYDROPHOBIC NONWOVEN FABRIC BONDED BY A COPOLYMER FORMED FROM A DIENE

[75] Inventors: George J. Antlfinger, Avon Lake; Pravinchandra K. Shah, Sheffield Lake, both of Ohio

[73] Assignee: The B. F. Goodrich Company, Akron, Ohio

[21] Appl. No.: 289,343

[22] Filed: Aug. 3, 1981

[51] Int. Cl.[3] ..... A61F 13/16; B32B 27/12; D04H 1/64

[52] U.S. Cl. ..... 604/370; 428/286; 428/287; 428/288; 428/290; 604/372; 604/381

[58] Field of Search ..... 428/290, 286, 287, 288; 128/290 W; 604/370, 372, 381

[56] References Cited

U.S. PATENT DOCUMENTS

| | | | |
|---|---|---|---|
| 4,119,746 | 10/1978 | Bleyle | 428/381 |
| 4,199,400 | 4/1980 | Bakule et al. . | |
| 4,234,651 | 11/1980 | Kuhn et al. | 428/290 |

OTHER PUBLICATIONS

Chemical Abstracts 71, 40167, (1969).
Chemical Abstracts 71, 82614, (1969).
Chemical Abstracts 75, 7369, (1971).

*Primary Examiner*—James C. Cannon
*Attorney, Agent, or Firm*—George A. Kap

[57] ABSTRACT

A nonwoven fabric comprising polyester fibers bonded with a water-insoluble, hydrophobic emulsion polymer of 50 to 80 parts by weight of an ethylenically unsaturated monomer selected from styrene, methyl methacrylate and α-methyl styrene, and 50 to 20 parts of a diene monomer selected from butadiene and isoprene, said polymer having a Tg in the range of −5° C. to +25° C.

11 Claims, No Drawings

HYDROPHOBIC NONWOVEN FABRIC BONDED BY A COPOLYMER FORMED FROM A DIENE

BACKGROUND OF THE INVENTION

A nonwoven fabric is a textile structure consisting of a mat of fibers held together with a bonding material. The fibers can be partially orientated or randomly distributed. A synthetic latex can be used as the binder for the fibers in nonwoven fabrics.

A number of methods have been developed for treating webs of fibers with a binder. Typically, a water-based emulsion binder system is used in which a thermoplastic or a thermosetting synthetic polymer latex is prepared and a loose web of fibers to be treated is immersed therein using special equipment, in view of the structural weakness of the web. The treated web is then dried and cured to effect proper bonding. Alternatively, an aqueous or a solvent solution binder system of a thermoplastic or thermosetting resin can be used to impregnate the web.

Still other methods include the application of thermoplastic or thermosetting resin powders to the fibers, before or after making a web of same, and passing the web through hot rolls or a hot press to bind the fibers together. Also, thermoplastic fibers having a softening point below that of the base fibers can be interspersed in a web of the latter and sufficient heat and pressure applied, such as by the use of heated rolls, to soften the thermoplastic fibers and bind the fiber network together.

SUMMARY OF THE INVENTION

This invention relates to hydrophobic nonwoven fabrics bonded with a water-insoluble hydrophobic binder selected from emulsion polymers of 50 to 80 parts styrene and 50 to 20 parts butadiene, said polymers having glass transition temperature (Tg) in the range of −5° C. to +25° C.

DETAILED DESCRIPTION OF THE INVENTION

The binders used to bond fibers of a nonwoven fabric described herein are latexes that are prepared by emulsion polymerization of butadiene and styrene. Amount of styrene can vary from 50 to 80 parts by weight and that of butadiene, 50 to 20 parts by weight. Styrene should be used in an amount that yields a film-forming polymer. In place of or in partial substitution of styrene, other hard monomers can be used such as α-methyl styrene, and methyl methacrylate. With respect to butadiene, in place of or in partial substitution thereof, other monomers such as isoprene, can be used. A small amount of a comonomer, not exceeding about 5 parts by weight, can be used to retard drying and thus facilitate the manufacture of such specific products as diapers on mechanized equipment. Examples of such comnomers include acrylamide, acrylic acid, methacrylic acid, itaconic acid and other hydrophilic monomers, especially monoethylenically unsaturated acrylic acids containing 3 to 6 carbon atoms. Especially suitable latex is one of butadiene, styrene and acrylamide in the respective ratios of 33/65/1.5 parts by weight.

Contrary to conventional practice, a multifunctional monomer need not be, although it can be, included in the binder composition described herein. The butadiene-styrene latex forms a microgel on its own without having to rely on the presence of the multifunctional monomer. Examples of such functional monomers are trimethylol propane trimethacrylate, trimethylol propane triacrylate, hexane diol diacrylate, pentaerythritol diacrylate, and tetremethylene glycol diacrylate that can be used at 0.5 to 2 parts by weight based on 100 parts by weight of the monomers.

Polymer latices embodied herein are prepared employing conventional polymerization techniques, preferably in an aqueous medium with a suitable polymerization catalyst. Overpolymerization of the monomers can also be used. Although latices are preferred, aqueous dispersions of solution polymers can be used.

In the preparation of the butadienestyrene latices, the aqueous medium can contain suitable emulsifiers or it can be emulsifier-free. When emulsifiers are used to prepare the latices of this invention, the usual types of anionic and non-ionic emulsifiers can be employed. Suitable anionic emulsifiers include alkali metal or ammonium salts of the sulfates of alcohols containing 8 to 18 carbon atoms such as sodium lauryl sulfate, alkali metal and ammonium salts of sulfonated petroleum and paraffin oils, sodium salts of sulfonic acids, aralkyl sulfonates, alkali metal and ammonium salts of sulfonated dicarbioxylic acid esters, and the like. Nonionic emulsifiers, such as octyl or nonylphenyl polyethoxyethanol, can also be used. Latices of excellent stability can be prepared with emulsifiers selected from alkali metal and ammonium salts of aromatic sulfonic acids, aralkyl sulfonates, long chain alkyl sulfonates, and poly (oxyalkylene) sulfonates.

Amount of emulsifiers can vary up to about 5 parts by weight per 100 parts by weight of the monomers and excellent results can be obtained with 0.01 to 1 part of an emulsifier. The emulsifier can be added at the outset of the polymerization or it can be added incrementally throughout the run. Typically, a substantial amount of the emulsifier is added at the outset of the polymerization and the remainder is added incrementally to the reactor as the monomers are proportioned.

The polymerization can be conducted at temperatures of about 5° C. or less to about 100° C. in the presence of a compound capable of initiating polymerization. Commonly used free radical initiators include the various peroxygen compounds such as persulfates, benzoyl peroxide, t-butyl hydroperoxide and cumene hydroperoxide; and azo compounds such as azodiisobutyronitrile and dimethylazodiisobutyrate. Particularly useful initiators are the water-soluble peroxygen compounds such as hydrogen peroxide and the sodium, potassium and ammonium persulfates used by themselves or in an activated redox system. Typical redox systems include alkali metal persulfates in combination with a reducing substance such as polyhydroxyphenols and oxidizable sulfur compounds, a reducing sugar, dimethylaminopropionitrile, a diazomercaptan compound, and a water-soluble ferricyanide compound. Polymer latices with excellent stability can be obtained using alkali metal and ammonium persulfate initiators. The amount of initiator used will generally be in the range of 0.1 to 3% by weight, based on the weight of the monomers, preferably between 0.2 to 1%. The initiator can be charged at the outset of the polymerization, however, incremental addition of the initiator throughout polymerization can also be employed and is often advantageous.

Typical polymerizations for the preparation of the latices described herein are conducted by charging the reactor with appropriate amount of water and electrolyte, if any is employed, emulsifier, and/or dispersant, if any, all of the monomers, and a portion of the initiator sufficient to initiate polymerization. The reactor is then evacuated and heated to the initiator temperature to commence the reaction. After the monomer charge has been allowed to react for a period of time, the proportioning of the remaining initiator can begin. After the final addition of initiator is made, the reactor and the latex are heated with agitation for a length of time necessary to achieve the desired conversion. The pH of the latex is generally in the range of about 6 to 10.

In the latex, the particle size may be in the range of about 1000 A°. A generally satisfactory particle size may be, however, from about 500° to about 5000 A°. The total solids of the latices may be varied up to about 70% and may relate to the fluidity wanted in the composition. Generally, it is desired to use a latex containing 40 to 60% solids.

Latexes suitable for the use described herein must be film formers. This is easily determined by placing a latex in an oven and drying it to see whether a film or a powder resin is formed. Film forming latexes from a powder resin type latex by the above test can be made by uniformly blending with the latex about 10 to 100 parts by weight of one or more plasticizers per 100 parts by weight of the resin. The useful plasticizers may be described as the alkyl and alkoxyalkyl esters of dicarboxylic acids or the esters of a polyhydric alcohol and a monobasic acd. As examples of such materials, there may be named dibutyl phthalate, dioctyl phthalate, dibutyl sebacate, di(2-ethyl hexyl) adipate, dilauryl phthalate, glyceryl stearate, and the like. The preferred plasticizers are the liquid diesters of aliphatic alcohols having from 4 to 20 carbon atoms and dibasic carboxylic acids having from 6 to 14 carbon atoms.

The latexes described herein can be compounded with, or have mixed therein, other known ingredients such as emulsifiers, curing agents, fillers, plasticizers, antioxidants or stabilizers, antifoaming agents, dyeing adjuvants, pigments, or other compounding aids. Furthermore, thickeners or bodying agents may be added to the polymer latices so as to control the viscosity of the latexes and thereby achieve the proper flow properties for the particular application desired.

A latex of the present invention can be applied to the web or mat of fibers in any suitable fashion such as by spraying, dipping, roll-transfer, or the like. Application of the latex to the fibers is preferably made at room temperature to facilitate cleaning of the associated apparatus. The solids concentration of the latex can be in the range of 5% to 60% by weight, and preferably from 5% to 25% when applied by dipping. When applied by roll-transfer, solids concentration of the latex is generally about 50% whereas with the spraying technique, it can range widely.

An acid catalyst is preferably included in the latex at the time it is applied to the fibrous web or it may be applied to the fibrous web before or after the latex is applied. Examples of acidic catalysts that may be employed include oxalic acid, dichloracetic acid, p-toluenesulfonic acid, and salts such as ammonium sulfate and hydrochloride of 2-methyl-2-aminopropanol-1.

The proportion of the latex polymer that is applied to the web or mat is such as to provide 10 to 100%, preferably 25 to 40% by weight of the polymer, based on the total weight of the polymer and fibers. After application of the latex to the fibrous web, the impregnated or saturated web is dried either at room temperature or at elevated temperature. The web is subjected, either after completion of the drying or as the final step of the drying stage itself, to a baking or curing operation which may be effected at a temperature of about 210° to about 750° F. for a period which may range from about one-half hour at the lower temperatures to as low as five seconds at the upper temperatures. The conditions of baking and curing are controlled so that no appreciable deterioration or degradation of the fibers or polymer occurs. Preferably, the curing is effected at a temperature of 250° to 325° F. for a period of 2 to 10 minutes.

The fibers that are bonded with the latices described herein are in the form of nonwoven mats or webs in which they are ordered or are randomly distributed. The web can be formed by carding when the fibers are of such a character, by virtue of length and flexibility, as to be amenable to the carding operation. The fibers need not be exclusively hydrophobic and may comprise natural textile fibers such as jute, sisal, ramie, hemp and cotton, as well as many of the artificial organic textile fibers including rayon, those of cellulose esters such as cellulose acetate, vinyl resin fibers such as those of polyvinyl chloride and copolymers thereof, polyacrylonitrile and copolymers thereof, polymers and copolymers of olefins such as ethylene and propylene, condensation polymers such as polyimides or nylon types, and the like. The fibers used can be those of a single composition or mixtures of fibers in a given web.

The preferred fibers are hydrophobic or a blend of fibers at least 50% by weight by which are hydropholic fibers, such as those of polyester, especially poly(ethylene terephthalate). Especially preferred are 100% polyester fibers.

The length of fibers is also important in producing fabrics of the present invention. The length should be a minimum of about 2 cm in order to produce uniform webs in the carding operation and it is preferred that the fiber length be between about 3 cm to about 4 cm although fibers 5 cm long and longer are useful particularly for wet laid webs. The denier of the fibers should be about 1 to 3, preferably about 1½.

The hydrophobic fibers of this invention are fibers that exhibit very little uptake of water upon water immersion or exposure to high humidity. This property can be measured by adsorption of water by a polymer film having a composition corresponding to that of the fibers or by the moisture regain of dehydrated fibers when held in an atmosphere of fixed relative humidity. Hydrophobic fibers are fibers having a moisture regain of less than 2.5%, preferably less than 1% of the fiber weight, measured at 70° F. and 65 relative humidity. For purposes of comparison, moisture regain of poly(ethylene terephthalate) is 0.4%, that of nylon 6 is 2.8 to 5.0%, that of cellulose acetate is 2.5 to 6.5%, that of viscose rayon is 11 to 13%, that of acrylic is 1 to 2.5%, for polyethylene it is negligible, and for polypropylene it is 0.1%.

Among the myriad of applications that can be listed for the binders described herein, the principal group relates to sanitary products particularly table napkins, bibs, tableclothes, sanitary napkins, disposable diapers, disposable sheets, surgical dressings and compresses. These products have a desirable degree of water resistance, as indicated by their wet strength, but at the same time maintain a level of water permeability so as to permit transport of body fluids, such as prespiration and urine, through the coverstock into the underlying absorptive pad.

One of the principal uses of the fabric of this invention is as diaper coverstock. Diaper coverstock is a moisture-pervious facing layer which permits urine initially impinged thereon to pass into the internal absorbent core of the diaper. The pad is covered by an outer impervious layer, such as plastic film. The facing layer, being in contact with the body of a baby, must be non-irritating and have an acceptable level of abrasion resistance at body temperature. Diaper coverstock must meet three principal tests, namely, tensile strength, strike through, and surface wetness. One diaper manufacturer requires a minimum of 170 g/in dry and 155 g/in wet tensile strength in across machine direction, a strike through of 7.0 seconds maximum, and surface wetness of 0.5 g maximum. Strike through is a measure of the speed of a urine solution passage through a diaper coverstock disposed on an absorbent layer. This test measures how fast it takes for 5 ml of urine solution to pass through a diaper cover stock of certain area. In measuring surface dryness, i.e., rewet, additional 15 ml urine solution is passed through the assembly that consists of a diaper coverstock on top with an absorbent layer below. A dry absorbent pad is then placed on the assembly and a weight of about 8 pounds is placed thereof. The weight of solution absorbed by the pad in a specified time period in grams is the measure of surface dryness.

It should be apparent that it is most desirable to have as low a strike through as possible in order to quickly remove urine in contact with baby's skin into the absorbent pad disposed beneath the inner coverstock and the outer water-impervious sheet of plastic film. However, as strike through is reduced, surface dryness increases. This condition is consonant with the wicking effect of the coverstock that allows the urine to pass through in one direction and then in the opposite direction. It should be apparent that as the passage of urine away from baby's skin is reduced, i.e., strike through is reduced, the increase in surface dryness is a direct reaction and must increase. The bonding latex is designed in order to strike a balance between these two properties. The latex described herein is of a hydrophobic nature that provides the desired balance between strike through and surface wetness properties. Since comonomers, such as acrylamide are hydrophilic, their presence in the binder copolymer can impart a hydrophilic character, depending on amount used. Presence of emulsifiers in the preparation of the copolymer binders also has a similar effect. These compounds can be used to advantage to obtain the desired characteristics in the diaper coverstock.

The following examples are presented for the purpose of illustrating the invention disclosed herein in a greater detail. The examples are not, however, to be construed to limit the invention herein in any manner, the scope of which is defined by the appended claims.

EXAMPLE 1

This example illustrates preparation of a latex of butadiene, styrene and acrylamide wherein the ratio of compounds is 33/65/1.5 parts by weight, respectively. This latex had a Tg of −15° C.

The latex was prepared by adding to a reactor 120 parts by weight of demineralized water, 1.5 parts ammonium salt of a sulfonate, 0.03 part of a salt of ethylene diamine tetraacetic acid, and 0.01 part of a strong inorganic acid. The contents of the reactor was mixed for about one-quarter of an hour and then, 1.5 parts of acrylamide and 65.0 parts of styrene were added. This was followed by evacuation of the reactor and addition of 33.5 parts of butadiene. Contents of the reactor was heated to 40° C. and 0.015 part of di-isopropyl benzene hydroperoxide initiator was added along with 0.01 part of a strong inorganic acid, to initiate the reaction. Additional initiator can be added during the reaction to continue polymerization. Upon reaching the desired conversion, reactor was cooled to room temperature and residual monomers were flashed-off. The resulting latex had the following properties:

total solids—45%
pH—9.3
Brookfield viscosity—20 cp at 27° C.
surface tension—52 dynes/cm

EXAMPLE 2

This example demonstrates impregnation of poly(ethylene terephthalate) webs at different pick-up levels of latex and subsequent testing for wet and dry tensile strength, strike through and surface dryness using a standard urine solution of about 45 dynes/cm surface tension that is an aqueous solution of sodium chloride in presence of a small amount of an nonionic emulsifier.

The polyester webs used in this example were corded polyester nonwoven webs weighing 0.5 oz/yd$^2$. The webs were impregnated with the latex of Example 1 used at 4, 6 and 8% solids to test effect of latex pick-up on the tested characteristics. Prior to impregnation, pH of the latex was adjusted to 8.5 with ammonium hydroxide. The impregnated webs were cured at 280° F. for 3 minutes before testing was undertaken. The pick-up was varied from 20% to about 55%. The results are set forth in Table I, below;

TABLE I

| % Pick Up | Tensile Strength Dry Grams/inch | Tensile Strength Wet Grams/inch | Strike Through, Seconds | Surface Dryness, Grams |
|---|---|---|---|---|
| 20.00 | 479.5 | 252.0 | 3.35 | 0.066 |
| 28.07 | 588.2 | 326.9 | 3.57 | 0.064 |
| 53.61 | 570.3 | 307.3 | 4.22 | 0.488 |

We claim:

1. A nonwoven fabric comprising fibers at least 50% of which are hydrophobic fibers bonded together by means selected from the group consisting essentially of a binder comprising a water-insoluble, hydrophobic polymer of unsaturated monomers comprising 50 to 80 parts by weight of an ethylenically unsaturated monomer selected from styrene, α-methyl styrene, methyl methacrylate and mixtures thereof, and 50 to 20 parts by weight of a diene monomer selected from butadiene, isoprene, and mixtures thereof, said bonded fabric has a minimum dry and wet tensile strength of 170 g/in and 155 g/in in across machine direction, respectively, a maximum strike through of 7.0 seconds, and a maximum surface wetness of 0.5 g.

2. Fabric of claim 1 wherein Tg of said binder is in the range of −5° C. to +25° C. and amount of said binder is about 10 to 100% by weight of the dry fibers.

3. Fabric of claim 1 wherein said unsaturated monomers include about 0.5 to 5 parts by weight of a hydrophilic monomer to reduce dry-out of said binder.

4. Fabric of claim 2 wherein said fibers are all polyester fibers and said polymer is prepared in absence of a multifunctional monomer and in absence of an emulsifier.

5. Fabric of claim 2 wherein said unsaturated monomers include about 0.1 to 5 parts by weight of a hydrophilic mnomer to reduce dry-out of said binder.

6. Fabric of claim 5 wherein said hydrophlic monomer is selected from acrylamide, acrylic acid, methacrylic acid and itaconic acid.

7. Fabric of claim 5 wherein said polyester fibers are poly(ethylene terephthalate) fibers and amount of said binder is 25 to 40% by weight of the dry fibers.

8. Fabric of claim 5 wherein said hydrophilic monomer is selected from acrylamide, acrylic and methacrylic acid and itaconic acid.

9. Fabric of claim 8 wherein said fibers are carded fibers about 2 to 5 cm in length and of about 1½ denier, said polymer being uncrosslinked.

10. Fabric of claim 8 wherein said binder is a film-forming polymer of 33 parts butadiene, 65 parts styrene and 1.5 parts acrylamide that is free of emulsifier.

11. A diaper comprising an outer water-impervious layer, an inner coverstock comprising nonwoven fabric of claim 7, and an intermediate absorbent pad.

* * * * *